US012269670B2

(12) United States Patent
van der Laan et al.

(10) Patent No.: US 12,269,670 B2
(45) Date of Patent: Apr. 8, 2025

(54) TRANSPORT DEVICE FOR TRANSPORTING A DELICATE OBJECT

(71) Applicant: ROLLOR I.P. B.V., 's-Gravenhage (NL)

(72) Inventors: Teun Kornelis van der Laan, 's-Gravenhage (NL); Alina Kaiser, 's-Gravenhage (NL); Peter Hoogland, 's-Gravenhage (NL)

(73) Assignee: ROLLOR I.P. B.V., 's-Gravenhage (NL)

( * ) Notice: Subject to any disclaimer, the term of this patent is extended or adjusted under 35 U.S.C. 154(b) by 132 days.

(21) Appl. No.: 18/010,959

(22) PCT Filed: Jun. 16, 2021

(86) PCT No.: PCT/NL2021/050378
§ 371 (c)(1),
(2) Date: Dec. 16, 2022

(87) PCT Pub. No.: WO2021/256925
PCT Pub. Date: Dec. 23, 2021

(65) Prior Publication Data

US 2023/0219743 A1 Jul. 13, 2023

(30) Foreign Application Priority Data

Jun. 16, 2020 (NL) ..... 2025839

(51) Int. Cl.
*B65D 5/00* (2006.01)
*B65D 5/02* (2006.01)
(Continued)

(52) U.S. Cl.
CPC ..... *B65D 85/307* (2013.01); *B65D 5/009* (2013.01); *B65D 5/029* (2013.01); *B65D 5/5011* (2013.01); *B65D 5/5016* (2013.01)

(58) Field of Classification Search
CPC ..... B65D 1/00; B65D 1/02; B65D 1/0207; B65D 1/0215; B65D 1/0223; B65D 1/023;
(Continued)

(56) References Cited

U.S. PATENT DOCUMENTS 2,306,328 A * 12/1942 Biberthaler ..... B65D 5/64 229/122.23
3,082,864 A * 3/1963 Silver ..... B65D 5/5026 229/162.6
(Continued)

FOREIGN PATENT DOCUMENTS

DE 4336993 C1 * 9/1994 ..... B65D 5/5021
EP 1736421 A1 * 12/2006 ..... B65D 23/001
(Continued)

*Primary Examiner* — Anthony D Stashick
*Assistant Examiner* — Marcos Javier Rodriguez Molina
(74) *Attorney, Agent, or Firm* — The Webb Law Firm

(57) ABSTRACT

The invention concerns a transport container for transporting a delicate object, comprising a casing which is divided in a length direction into casing segments (1), provided with at least two upright edges (6) situated spaced apart from one another in a width direction extending transversely to the length direction and divided into edge segments corresponding to the casing segments, wherein two adjacent casing segments together with the corresponding edge segments are foldable about a common rotational axis situated in the plane of the casing, wherein the edge segments are, thanks to a folded structure, rigid in at least one direction perpendicular to the plane of the corresponding casing segments.

27 Claims, 4 Drawing Sheets

(51) Int. Cl.
*B65D 5/50* (2006.01)
*B65D 85/30* (2006.01)

(58) Field of Classification Search
CPC .. B65D 1/0238; B65D 1/0246; B65D 1/0276; B65D 1/0284; B65D 1/0292; B65D 1/09; B65D 1/10; B65D 1/24; B65D 1/243; B65D 1/36; B65D 1/38; B65D 1/40; B65D 1/42; B65D 11/04; B65D 11/06; B65D 17/34; B65D 17/4012; B65D 19/0073; B65D 19/10; B65D 19/12; B65D 19/14; B65D 19/18; B65D 19/20; B65D 19/385; B65D 19/44; B65D 21/02; B65D 21/0202; B65D 21/0204; B65D 21/0209; B65D 21/0224; B65D 21/0231; B65D 21/0233; B65D 21/0235; B65D 21/0237; B65D 21/04; B65D 21/08; B65D 21/086; B65D 2203/00; B65D 2203/02; B65D 2203/04; B65D 2203/06; B65D 2203/10; B65D 2207/00; B65D 2209/00; B65D 2211/00; B65D 2251/0015; B65D 2251/0093; B65D 2251/01; B65D 2251/02; B65D 2251/023; B65D 23/003; B65D 23/02; B65D 23/06; B65D 23/065; B65D 23/08; B65D 23/0842; B65D 23/085; B65D 3/0878; B65D 23/0885; B65D 23/10; B65D 23/104; B65D 23/12; B65D 23/14; B65D 23/012; B65D 2303/00; B65D 2401/00; B65D 2401/05; B65D 25/005; B65D 25/04; B65D 25/06; B65D 25/08; B65D 25/14; B65D 25/0205; B65D 25/2873; B65D 25/2885; B65D 25/30; B65D 25/34; B65D 25/52; B65D 2501/0036; B65D 2501/0081; B65D 2501/24108; B65D 2501/24114; B65D 2501/24133; B65D 2501/24152; B65D 2501/24184; B65D 2501/24216; B65D 2501/24254; B65D 2501/24261; B65D 2501/24324; B65D 2501/2435; B65D 2501/24515; B65D 2501/24522; B65D 2501/24528; B65D 2501/24541; B65D 2501/24605; B65D 2501/24656; B65D 2501/24681; B65D 2501/24694; B65D 2501/24777; B65D 2501/24808; B65D 2519/00019; B65D 2519/00029; B65D 2519/00034; B65D 2519/00054; B65D 2519/00059; B65D 2519/00064; B65D 2519/00069; B65D 2519/00129; B65D 2519/00159; B65D 2519/00164; B65D 2519/00169; B65D 2519/00174; B65D 2519/00194; B65D 2519/00199; B65D 2519/00203; B65D 2519/00208; B65D 2519/00233; B65D 2519/00273; B65D 2519/00293; B65D 2519/00323; B65D 2519/00333; B65D 2519/00373; B65D 2519/00452; B65D 2519/00457; B65D 2519/00497; B65D 2519/00512; B65D 2519/00562; B65D 2519/00572; B65D 2519/00606; B65D 2519/00621; B65D 2519/00626; B65D 2519/00666; B65D 2519/00691; B65D 2519/00701; B65D 2519/00711; B65D 2519/00751; B65D 2519/00805; B65D 2519/0081; B65D 2519/00995; B65D 2543/0037; B65D 2543/00842; B65D 2543/00851; B65D 2543/00935; B65D 2565/385; B65D 2571/00043; B65D 2571/00061; B65D 2571/00141; B65D 2571/00154; B65D 2571/00166; B65D 2571/00203; B65D 2571/00222; B65D 2571/00265; B65D 2571/00277; B65D 2571/0029; B65D 2571/00314; B65D 2571/0032; B65D 2571/00358; B65D 2571/00388; B65D 2571/00401; B65D 2571/00419; B65D 2571/00444; B65D 2571/0045; B65D 2571/00456; B65D 2571/00469; B65D 2571/00475; B65D 2571/00487; B65D 2571/00524; B65D 2571/00543; B65D 2571/00549; B65D 2571/00561; B65D 2571/00567; B65D 2571/00571; B65D 2571/0058; B65D 2571/00592; B65D 2571/00604; B65D 2571/00635; B65D 2571/0066; B65D 2571/00716; B65D 2571/00722; B65D 2571/00728; B65D 2571/00746; B65D 2571/00753; B65D 2571/00783; B65D 2571/0079; B65D 2571/00802; B65D 2571/00808; B65D 2571/00851; B65D 2571/00858; B65D 2571/00864; B65D 2571/0087; B65D 2571/00882; B65D 2571/00895; B65D 2571/00913; B65D 2571/00932; B65D 2571/00987; B65D 2571/00993; B65D 2577/043; B65D 2581/051; B65D 2581/053; B65D 2581/055; B65D 2585/88; B65D 2590/0058; B65D 2590/0066; B65D 2590/0091; B65D 27/30; B65D 33/002; B65D 33/06; B65D 33/12; B65D 33/2541; B65D 39/0005; B65D 39/0029; B65D 39/0052; B65D 39/16; B65D 41/02; B65D 41/04; B65D 41/045; B65D 41/0464; B65D 41/0471; B65D 41/225; B65D 41/26; B65D 41/3428; B65D 41/348; B65D 41/349; B65D 41/62; B65D 43/0202; B65D 43/0212; B65D 43/16; B65D 43/162; B65D 45/322; B65D 47/00; B65D 47/06; B65D 47/08; B65D 47/089; B65D 47/24; B65D 47/248; B65D 47/40; B65D 5/0005; B65D 5/001; B65D 5/002; B65D 5/003; B65D 5/006; B65D 5/008; B65D 5/009; B65D 5/02; B65D 5/0218; B65D 5/0227; B65D 5/0236; B65D 5/0245; B65D 5/0281; B65D 5/026; B65D 5/10; B65D 5/103; B65D 5/20; B65D 5/2076; B65D 5/22; B65D 5/28; B65D 5/327; B65D 5/3614; B65D 5/3621; B65D 5/3628; B65D 5/38; B65D 5/42; B65D 5/4204; B65D 5/4208; B65D 5/422; B65D 5/4233; B65D 5/4266; B65D 5/4279; B65D 5/4295; B65D 5/44; B65D 5/443; B65D 5/445; B65D 5/46016; B65D 5/46072; B65D 5/4608; B65D 5/48; B65D 5/48002; B65D 5/48014; B65D 5/4802; B65D 5/48024; B65D 5/48026; B65D 5/48028; B65D 5/48038; B65D 5/4804; B65D 5/48044; B65D 5/48048; B65D 5/5002; B65D 5/5007; B65D 5/5009; B65D 5/5011; B65D 5/5014; B65D 5/5016; B65D 5/5021; B65D 5/5023; B65D 5/5028; B65D 5/503; B65D 5/5033; B65D 5/5035; B65D 5/5038; B65D 5/5042; B65D 5/5045; B65D 5/5052; B65D 5/5061; B65D 5/5069; B65D 5/508; B65D 5/5083; B65D 5/5088; B65D 5/524; B65D 5/5253; B65D 5/526; B65D 5/5286; B65D 5/54; B65D 5/541; B65D 5/5415; B65D 5/542; B65D 5/5445; B65D 5/545; B65D 5/58; B65D 5/60; B65D 5/6602; B65D 5/6626; B65D 5/6635; B65D 5/6655; B65D 5/6661; B65D 5/72; B65D 5/725; B65D 50/045; B65D 50/046; B65D 51/1616; B65D 51/1638; B65D 51/1661; B65D 51/1683; B65D 51/20; B65D 51/24; B65D 51/242; B65D 51/248; B65D 51/249; B65D 51/28; B65D 51/2807; B65D 53/02; B65D 55/028; B65D 55/06; B65D 55/08118; B65D 55/0854; B65D 59/04; B65D 65/00; B65D 65/02; B65D 65/38; B65D 65/403; B65D 65/42; B65D 65/466; B65D 7/26; B65D 71/00; B65D 71/0003; B65D 71/0022; B65D 71/0055; B65D 71/0096; B65D 71/02; B65D 71/063; B65D 71/16; B65D 71/18; B65D 71/22; B65D 71/32; B65D 71/36; B65D 71/44; B65D 71/50; B65D 71/504; B65D 71/508; B65D 71/70; B65D 73/0035; B65D 73/0885; B65D 75/002; B65D 75/008; B65D 75/327; B65D 75/34; B65D 75/52; B65D 75/527; B65D 75/56; B65D 75/563; B65D 75/5811; B65D 75/5866; B65D 75/5877; B65D 75/5883; B65D 77/003; B65D 77/042; B65D 77/0426; B65D 77/0446; B65D 77/0453; B65D 77/048; B65D 77/0486; B65D 77/06; B65D 77/061; B65D 77/065; B65D 77/067; B65D 77/24; B65D 77/26; B65D 77/32; B65D 77/36; B65D 79/02; B65D 81/02; B65D 81/022; B65D 81/025; B65D 81/027; B65D 81/03; B65D 81/05; B65D 81/055; B65D 81/09; B65D 81/107; B65D 81/113; B65D 81/127; B65D 81/133; B65D 81/18; B65D 81/20; B65D 81/24; B65D 81/267; B65D 81/28; B65D 81/3205; B65D 81/3266; B65D 81/3288; B65D 81/36; B65D 81/365; B65D 81/3813; B65D 81/3816; B65D 81/3818; B65D 81/3823; B65D 81/3825; B65D 81/3827; B65D 81/383; B65D 81/3832; B65D 81/3841; B65D 81/386; B65D 81/3862; B65D 81/3876; B65D 81/3881; B65D 81/3893; B65D 81/3897; B65D 83/005; B65D 83/0055; B65D 83/02; B65D 83/0409; B65D 83/0847; B65D 83/38; B65D 83/425; B65D 83/44; B65D 83/54; B65D 85/30; B65D 85/305; B65D 85/307; B65D 85/50; B65D 85/505; B65D 88/121; B65D 88/126; B65D 88/129; B65D 88/542; B65D 9/04; B65D 90/0033; B65D 90/006; B65D 90/10; B65D 90/20; B65D 90/205; B65D 90/22; B65D 90/48; B65D 1/34; B65D 19/38; B65D 2251/1025; B65D 2251/105; B65D 25/10; B65D 25/20; B65D 25/205; B65D 25/24; B65D 2543/00092; B65D 2543/00296; B65D 2543/00537; B65D 2571/0063; B65D 2571/006; B65D 2575/586; B65D 2581/3472; B65D 2581/3494; B65D 3/22; B65D 31/02; B65D 33/00; B65D 33/01; B65D 33/20; B65D 33/2508; B65D 33/541; B65D 5/029; B65D 55/0818; B65D 65/14; B65D 65/22; B65D 65/40; B65D 65/46; B65D 73/0085; B65D 73/02; B65D 75/26; B65D 75/30; B65D 75/54; B65D 75/58; B65D 75/5805; B65D 75/5827; B65D 75/5838; B65D 75/5855; B65D 77/2024; B65D 81/052; B65D 81/264; B65D 81/266; B65D 81/3453; B65D 81/3461; B65D 81/3842; B65D 83/0005; B65D 83/08; B65D 83/0805; B65D 85/00; B65D 85/04; B65D 85/07; B65D 85/10; B65D 85/1045; B65D 85/34; B65D 85/36; B65D 85/48; B65D 85/52; B65D 85/66; B65D 85/672; B65D 85/68; B65D 85/72; B65D 88/022; B65D 88/12; B65D 88/14; B65D 88/54; B65D 90/00; B65D 90/18

USPC ..... 206/0.5, 0.6, 0.7, 0.82, 0.83, 0.84, 1.5, 206/1.7, 119, 139, 15.2, 15.3, 150, 151, 206/158, 161, 162, 170, 204, 205, 207, 206/209, 210, 213.1, 216, 217, 219, 221, 206/222, 223, 225, 226, 227, 229, 232, 206/233, 234, 235, 236, 237, 242, 245, 206/254, 256, 259, 260, 264, 265, 267, 206/268, 270, 271, 273, 274, 277, 278, 206/279, 287, 287.1, 292, 293, 298, 3, 206/302, 303, 304, 304.2, 306, 308, 206/308.1, 308.3, 309, 315.1, 315.11, 206/315.2, 315.3, 315.4, 315.5, 315.6, 206/315.9, 316.1, 316.2, 317, 318, 320, 206/321, 322, 323, 326, 335, 338, 343, 206/344, 345, 349, 361, 362, 363, 364, 206/365, 366, 367, 368, 37, 370, 372, 206/373, 379, 38, 380, 384, 386, 387.1, 206/387.13, 388, 389, 39.4, 39.8, 390, 206/391, 392, 393, 394, 396, 397, 398, 206/400, 402, 403, 404, 405, 407, 408, 206/409, 410, 411, 412, 413, 414, 415, 206/416, 417, 419, 423, 424, 425, 427, 206/428, 429, 430, 432, 433, 434, 438, 206/440, 441, 443, 445, 446, 447, 448, 206/449, 45.2, 45.23, 45.25, 45.26, 45.29, 206/451, 453, 454, 455, 457, 459.1, 206/459.5, 460, 461, 462, 463, 466, 467, 206/468, 469, 470, 471, 472, 478, 480, 206/482, 483, 484, 484.1, 484.2, 485, 206/486, 489, 493, 494, 495, 497, 499, 5, 206/5.1, 501, 503, 504, 505, 506, 507, 206/508, 509, 511, 512, 514, 515, 516, 206/518, 519, 520, 521, 521.1, 522, 523, 206/524.1, 524.2, 524.3, 524.4, 524.5, 206/524.6, 524.7, 524.8, 525, 526, 527, 206/528, 53, 531, 532, 533, 534, 534.1, 206/535, 536, 538, 539, 54, 540, 541, 206/545, 55, 550, 551, 553, 554, 555, 206/557, 558, 561, 562, 563, 564, 565,

206/568, 570, 571, 572, 573, 575, 576, 206/579, 581, 583, 584, 585, 586, 591, 206/592, 593, 594, 595, 596, 597, 598, 206/599, 6.1, 600, 63.3, 63.5, 69, 703, 206/71, 710, 711, 713, 714, 719, 736, 206/741, 742, 748, 750, 751, 754, 756, 206/761, 762, 764, 765, 772, 774, 776, 206/780, 784, 8, 800, 803, 804, 805, 806, 206/807, 810, 811, 812, 813, 814, 815, 206/816, 818, 819, 820, 821, 822, 823, 206/824, 825, 83.5, 830, 831

See application file for complete search history.

(56) References Cited

U.S. PATENT DOCUMENTS

| | | | | |
|---|---|---|---|---|
| 3,438,482 | A | 4/1969 | Hamilton | |
| 4,234,080 | A * | 11/1980 | Gellert | B65D 1/00 220/4.23 |
| 5,806,683 | A | 9/1998 | Gale | |
| 6,926,196 | B2 | 8/2005 | Testerman et al. | |
| 8,459,190 | B2 | 6/2013 | Erdie | |
| 9,199,767 | B1 * | 12/2015 | Pheir | B65D 25/04 |
| 2005/0199696 | A1 * | 9/2005 | MacConkey | B65D 5/029 229/137 |
| 2012/0228366 | A1 * | 9/2012 | Nieto | B65D 5/029 229/109 |
| 2013/0157832 | A1 * | 6/2013 | Erdie | B65D 19/0012 493/405 |

FOREIGN PATENT DOCUMENTS

| | | | | |
|---|---|---|---|---|
| FR | 2681579 | A1 * | 3/1993 | B65D 5/5016 |
| FR | 2725423 | A1 * | 4/1996 | B65D 5/009 |
| GB | 773675 | | 5/1957 | |
| GB | 773675 | A * | 5/1957 | B65D 5/5011 |
| WO | WO-2007029027 | A1 * | 3/2007 | B65D 33/002 |

* cited by examiner

TRANSPORT DEVICE FOR TRANSPORTING A DELICATE OBJECT

CROSS-REFERENCE TO RELATED APPLICATIONS

This application is the United States national phase of International Application No. PCT/NL2021/050378 filed Jun. 16, 2021, and claims priority to The Netherlands Patent Application No. 2025839 filed Jun. 16, 2020, the disclosures of which are hereby incorporated by reference in their entireties.

BACKGROUND OF THE INVENTION

Field of the Invention

The present invention concerns a transport container for transporting a delicate object, in particular for transport by postal services.

Transport containers for transporting delicate objects are known from the prior art, and in general serve to ensure that delicate objects are well packed and thus do not break during transport.

Description of Related Art

Such transport containers are usually provided with means for protecting the object. Thus a container may be provided with a foam which is cut out so that the object fits in precisely. Also, such a container may be provided with sealing means such as for example a loop which is tied around the object. These means are usually arranged in or on the transport container in order to transport an object safely. A great disadvantage associated therewith is the fact that different means are necessary for protecting each object. In addition, the packaging is often unnecessarily complex, and in particular packaging with preformed plastic or polystyrene containers takes up a great deal of space before and after use for transport. In addition, plastic and polystyrene packagings have the disadvantage of being environmentally harmful.

SUMMARY OF THE INVENTION

It is therefore the object of the present invention to create a transport container which eliminates the above-mentioned disadvantages or at least offers a usable alternative to containers according to the prior art.

The present invention achieves this object by means of a transport container for transporting a delicate object, comprising a casing which is divided in a length direction into several casing segments, wherein the casing is provided with at least two upright edges extending in the length direction and situated spaced apart from one another in a width direction extending transversely to the length direction, wherein the upright edges are divided into edge segments corresponding to the casing segments, wherein at least two adjacent casing segments each comprise at least two edge segments situated spaced apart from one another in the width direction, wherein the at least two adjacent casing segments together with the corresponding edge segments are foldable about a common rotational axis situated in the plane of the casing, wherein the edge segments are rigid in at least one direction perpendicular to the plane of the corresponding casing segments.

By means of upright edges which are rigid in a direction perpendicular to the casing, the present invention in a first embodiment forms a transport space by folding. The upright edges are thus formed by several edge segments, wherein one edge segment of one upright edge substantially corresponds to a casing segment on which it is placed. The rigid property of the upright edges and hence also the edge segments is attributable to the folded structure, and initially not or at least not only to the material properties of the material from which the structure is made. The upright edge and hence the edge segments are preferably formed from a material part from which the casing is also formed, but which extends outside the region of this casing folded up to the upright edge, but it is also conceivable that the upright edge and hence the edge segments are separate parts which are attached to the casing. This may be achieved for example by folding the upright edges separately and attaching these to the casing by using e.g. an adhesive. Because the upright edges and hence also the edge segments are folded, a force in a direction perpendicular to the casing is more evenly distributed over the casing. Preferably, the upright edges and hence the edge segments are sufficiently rigid that a significant compressive force on the upright edge will not deform this plastically. Such a significant force may for example be a force which is exerted on the rigid upright edge when, for example, a large stack of heavy packages lies on the transport device according to the invention during transport. The rigid upright edge is able to tolerate without deformation a force of at least 5 Newton, preferably at least 50 Newton, and more preferably at least 100 Newton, wherein this force is exerted on the rigid upright edge with at least one component perpendicular to the plane of the casing. It is also conceivable that the rigid upright edge can withstand a force of 500 Newton without deforming plastically under the exerted force. The more even distribution of the forces by the upright edge is achieved in particular in that a force exerted on an upright edge is distributed through the segments of the edge and thereby conducted more evenly into the casing. If an edge segment for example has a triangular cross-section, and the pointed side of this triangle is situated on the side facing away from the casing, and a force is exerted on this narrow side such as e.g. pushing the packet inwards, this force will be distributed over the two legs of the triangular shape. It is also noted that the triangular cross-section is purely indicative. A similar effect is achieved if the upright edge and hence also the edge segments have a circular or rectangular or other cross-section. The dimensions of the transport space may be configured according to the object to be transported. By making the upright edges larger, a larger transport space may be formed. Also by enlarging the segments or increasing the number of segments, the length of the transport space may be enlarged. Therefore the present invention is suitable for forming a safe transport container for a diversity of objects. Preferably, the upright edges stand substantially parallel to one another, but in an alternative embodiment it is conceivable that the upright edges run conically towards one another in the length direction and thus can safely accommodate a conical object in the transport space.

In a further embodiment variant of the present invention, the region which extends in the width direction between the at least two upright edges is free from obstacles, preferably over some, preferably over two casing segments or more casing segments, and further preferably over the entire length direction of the casing. This means that the transport space resulting in folded state forms a cohesive space for accommodating the object or for forming protection for the object, depending on embodiment.

In an alternative embodiment variant, the transport container is made of a material having a weight between 0 and 500 g/m$^2$ and/or a density between 0 and 0.04 g/cm$^3$. In this way, a lightweight transport container may be produced which is also strong because of its structure. This keeps transport costs low and prevents unnecessary use of energy.

In yet another alternative embodiment variant of the present invention, a width of each of the edge segments at least on the casing side is substantially equal to the width of the corresponding casing segment. In this way, the adjacent edge segments, i.e. those adjacent in the length direction of the casing, adjoin one another substantially seamlessly at least on the casing side. This adjacent arrangement not only ensures stiffness because the parts are concealed by one another, but also prevents the interior of the container in folded form, i.e. in transport form, from being accessible for soiling.

In yet another alternative embodiment variant of the present invention, a width of each of the edge segments on a side of the edge segment facing away from the casing is narrower than the corresponding casing segment. This ensures that on at least one side of the upright edge facing away from the casing, a space is created between the adjoining edge segments. Because of this space, the present invention allows two adjacent casing segments together with the corresponding edge segments to be more easily foldable about the common axis. Preferably, the narrow side of the edge segment is narrower such that in folded state, the line which extends from an end point of the edge segment on the casing side to an end point of the edge segment on the side away from the casing, lies substantially on the same line of the adjoining casing segment. Thus in folded state, a side face of the transport container is formed in which the edge segments lie completely on one another. A recurrent advantage is that such a closed side face offers more stiffness and also it is not possible for dirt to penetrate the transport container.

In yet a further embodiment variant, a region which extends between two adjacent edge segments contains a bendable element, wherein the two adjacent edge segments are connected together with the interposition of the bendable element.

This further embodiment variant ensures more stiffness in folded state. All edge segments are connected together by the bendable element, which ensures a more solid assembly. In yet a further embodiment variant, the bendable element is bendable with at least one direction component in a direction perpendicular to the casing. Preferably, the bendable element bends in a direction towards the casing. Thus all bendable elements bend inwards during folding of the transport container, and in folded state the bendable element is not visible from the outside. It is conceivable that in folded state, the bendable elements rest on the casing so that the bendable elements contribute to the rigid property of the edge segments.

In a further alternative embodiment, the bendable element is a bridge between adjacent edge segments, wherein the bridge is bendable in a direction perpendicular to the casing, and wherein in an unbent state, the bridge extends in a plane substantially parallel to a plane in which the casing extends. This embodiment is particularly suitable for an edge segment in which there is a face on the side facing away from the casing, wherein a cross-section is quadrangular. The bridge ensures that during folding, the casing does not unfold further than into a sheet. In other words, from a folded state in which the bridge is bent inward, the casing of the transport container can be unfolded into a sheet, wherein the bridges will unbend so that they extend in a plane parallel to that of the casing, so that further unfolding is not possible. The advantage also applies here that the bridges connect all edge segments together, giving a more rigid transport container overall.

In yet another alternative embodiment variant, the upright edge has a substantially triangular cross-section. In yet another embodiment, mutually facing faces of the upright edges stand substantially perpendicular to the casing. A triangle is usually rigid in at least one direction, and therefore is a suitable cross-sectional form for the upright edge. Also, a triangle can be produced from relatively little material in comparison with other conceivable forms.

In yet an alternative embodiment, an end in the length direction of the casing is provided with a core piece, wherein the core piece comprises at least a first and a second end face, wherein the first and second end faces stand substantially perpendicular to the plane of the casing, and wherein the transport container is foldable about the core piece. The core piece means that the transport container is more easily foldable about the core piece. Thus the transport container can be folded intuitively. The end faces of the core piece are provided with faces which stand perpendicular to the casing in order to provide stiffness for the core piece.

In a further particular embodiment variant, after folding, the first and second end faces of the core piece rest on the two mutually facing faces of the upright edges. Such a configuration prevents twisting of the transport container. It furthermore contributes to the intuitive folding of the transport container, since it is clear that the faces rest on one another. Thus the mutually facing faces of the upright edges form a guide for the two end faces of the core piece.

A further particular embodiment variant, the core piece is configured for engaging with a bottle in various positions in the width direction of the container, wherein the core piece is provided with engagement means for restricting or hindering a radial freedom of movement of the bottle. In particular, the core piece is configured for engaging around the bottle, wherein the bottle is situated in the core piece. This ensures that the bottle has extra protection during transport in the transport container.

In yet a further embodiment variant, the engagement means are provided at least with a first engagement part, wherein the first engagement part has a first inner diameter, and a second engagement part, wherein the second engagement part has a second inner diameter, wherein the first and second inner diameters are different. Such an engaged bottle can no longer move in the transport container and can enjoy maximum protection during transport. It is conceivable that the first engagement part engages on a wide part of the bottle, and the second engagement part engages on a second narrower part of the bottle, such as the bottle neck. By providing the core piece with at least two engagement parts, the position of the bottle relative to the casing may be established. In a further particular embodiment, the first and the second engagement parts are formed from a part of the core piece, and the shape of the core piece and the engagement parts together ensures that the bottle does not rest against the casing in a folded transport container.

In a further embodiment variant, at least the first and/or the second end face of the core piece is also provided with reinforcement for supporting a base of the bottle, wherein the reinforcement rests on the first and/or second end face. The reinforcement ensures that the base of the bottle has sufficient support. During transport, the base of the bottle lies on the end face which is provided with reinforcement. In particular, it is conceivable that in a folded state, the base of a bottle on a first side rests on the end face of the core piece, wherein a second side facing away from the first side rests on two mutually facing faces of the upright edge, wherein the mutually facing faces of the upright edge are situated at a distance from the edge of the casing. In this way, the base of the bottle is also situated at a distance from the edge of the casing. This ensures that in folded state of the transport container, the bottle is situated at a distance on all sides from the casing of the transport container.

In yet an alternative embodiment variant, the transport container is completely foldable from one sheet. This has the advantage that transport containers according to the invention can be transported both folded and in sheet form. Transporting as flat sheets takes up less volume, so large quantities of the transport container can be transported in a relatively restricted volume. The sheet from which the transport container can be folded may be provided with recesses and cutouts for simplifying folding. Thus an upright edge with a triangular cross-section may be formed from two fold lines, often however a third fold line is desirable: the third fold line ensures that a base surface is formed for the upright edge which rests on the casing.

In yet a further embodiment variant, the upright edge also contains a lock for locking the upright edge on the casing in a folded state, wherein the lock is formed by at least one first lip in the casing which preferably engages foldably on at least one second lip in the upright edge, wherein the at least one second lip is arranged in mutually facing faces of the upright edge. It is possible to fold the transport container from one sheet, but to ensure that the transport container can be assembled correctly, locks are desirable. Thus for example first the upright edge may be folded from the sheet, followed by the locking of the upright edge. This ensures that the upright edge is connected to the casing, and then the core piece may be folded from the sheet without the upright edge unfolding under the internal stress. Then the delicate object may be carefully placed in the space between the upright edges or locked in the core piece, depending on embodiment variant.

In a further embodiment variant, the at least one first lip has a protrusion which engages in a corresponding recess in the at least one second lip. The first and second lips may also be made from the one sheet; by cutting out the contour of the lip, this may be folded over to engage in a recess in the second lip corresponding to the protrusion. Preferably, the first lip is provided on the upright edge and the second lip is provided on the casing, so that during engagement, the upright edge is anchored to the casing. The mutual engagement of the lips is also releasable, whereby it is also possible to fold and unfold the upright edge several times.

In a further alternative embodiment, the lock is formed by at least one lip in the casing, wherein the lip engages in a recess in the upright edge. The recess in the upright edge is preferably situated completely in one of the segments and corresponds to a contour of the lip. The engagement of the lip in the recess results in an anchoring of the upright edge on the casing. It is furthermore possible to release the lip, whereby the upright edge can be folded and unfolded several times.

In an alternative embodiment variant of the present invention, the casing also comprises a cover for at least partially and preferably completely covering a side face of the transport container after folding. Such a cover gives a pleasing and uniform appearance of the transport container; also, the side face of the transport container in folded state is further protected by the cover, whereby the product to be transported is better protected.

In yet another embodiment variant, from a side view, the transport container has a substantially polygonal form after folding. In yet an alternative embodiment, the length of the separate edge segments differs, wherein after folding, the different edge segments create a substantially helical cavity. Thus it may be chosen to select the length of the casing such that several revolutions can be made by the casing. In a variant in which only one revolution is necessary, a helical form is not always required and it may also be chosen to create the revolution from identical segments.

The transport container according to the invention may also be provided with a closing means. This may be formed by an adhesive strip, or by a collar or flap which extends from an end of the casing and can be connected to a part of the casing situated one revolution away from the flap.

BRIEF DESCRIPTION OF THE DRAWINGS

The present invention will be explained briefly below with reference to the following figures in which.

DESCRIPTION OF THE INVENTION

Figure 1:
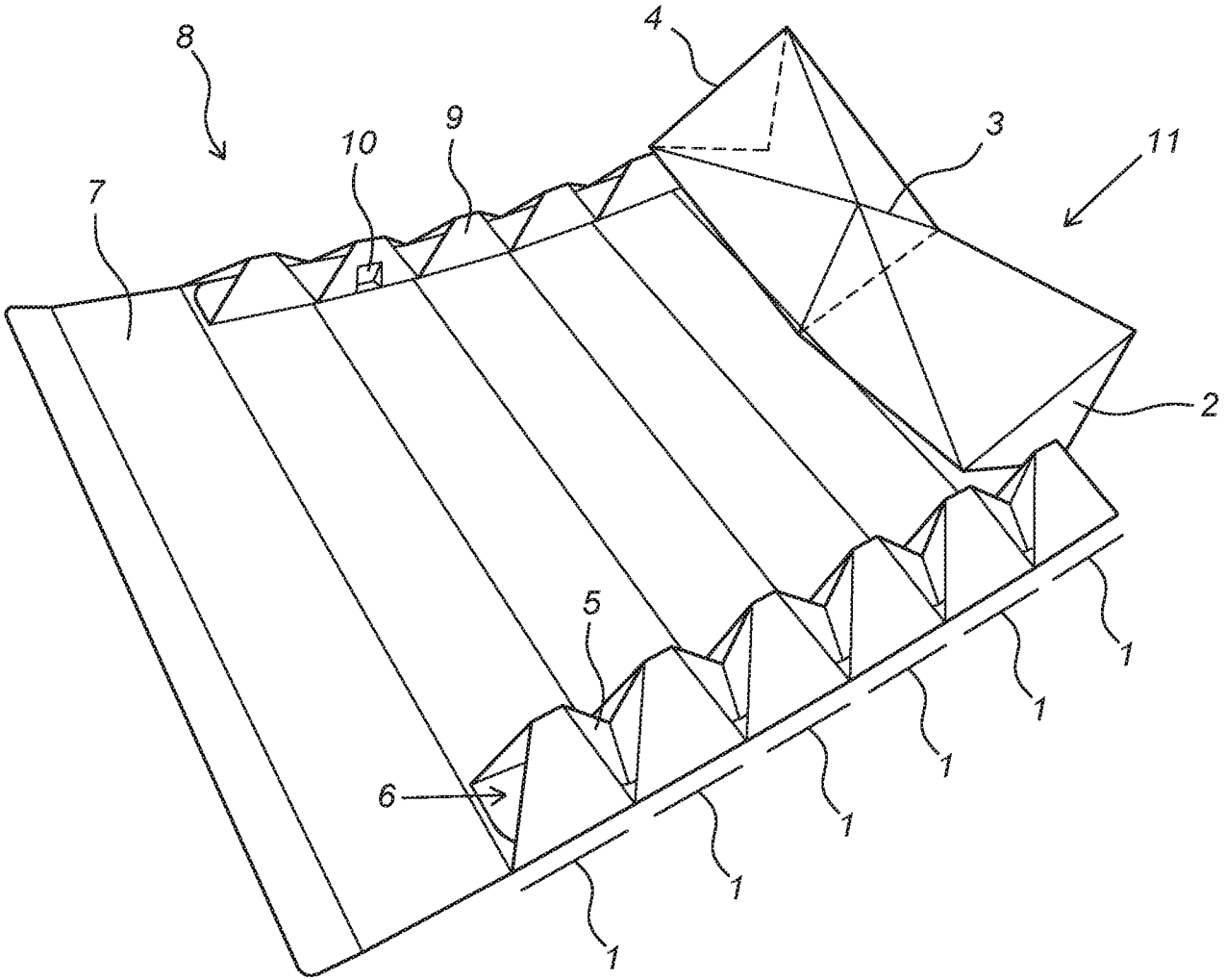
FIG. 1 shows an illustration of a first embodiment of the transport container.

FIG. 1 shows a first embodiment variant of the present invention. The figure shows a transport container 8 for transporting a delicate object, comprising a casing 7 which is divided in a length direction into casing segments 1, wherein the casing is provided with at least two upright edges 6 extending in the length direction and spaced apart from one another in a width direction extending transversely to the length direction, wherein the upright edges 6 are divided into edge segments 1 corresponding to the casing segments 1, wherein at least two adjacent casing segments 1 each comprise at least two edge segments 1 situated spaced apart from one another in the width direction, wherein the at least two adjacent casing segments 1 together with the corresponding edge segments 1 are foldable about a common rotational axis 25 situated in the plane of the casing 7, wherein the edge segments 1 are rigid in at least one direction perpendicular to the plane of the corresponding casing segments 1. Also, in this embodiment variant, an end in the length direction of the casing 7 of the transport container 8 is provided with a core piece 11, wherein the core piece 11 comprises at least a first end face 2 and a second end face, wherein the first end face 2 and the second end face stand substantially perpendicular to the plane of the casing 7, and wherein the transport container 8 is foldable about the core piece 11. After folding, the first end face 2 and second end face of the core piece 11 lie on two mutually facing faces 9 of the upright edges 6. In this embodiment, the core piece 11 is configured for engaging with a bottle in different positions in the width direction of the container 8, wherein the core piece 11 is provided with engagement means 3, 4 for limiting or hindering a radial freedom of movement of the bottle. In this variant, the engagement means are provided with a first engagement part 3, wherein the first engagement part has a first inner diameter, and a second engagement part 4, wherein the second engagement part has a second inner diameter. The upright edges 6 are folded from the plane of the casing, and in order to lock these to the casing, the upright edges 6 of the transport container 8 have a lock 10 which connects the upright edges to the casing.

Figure 2:
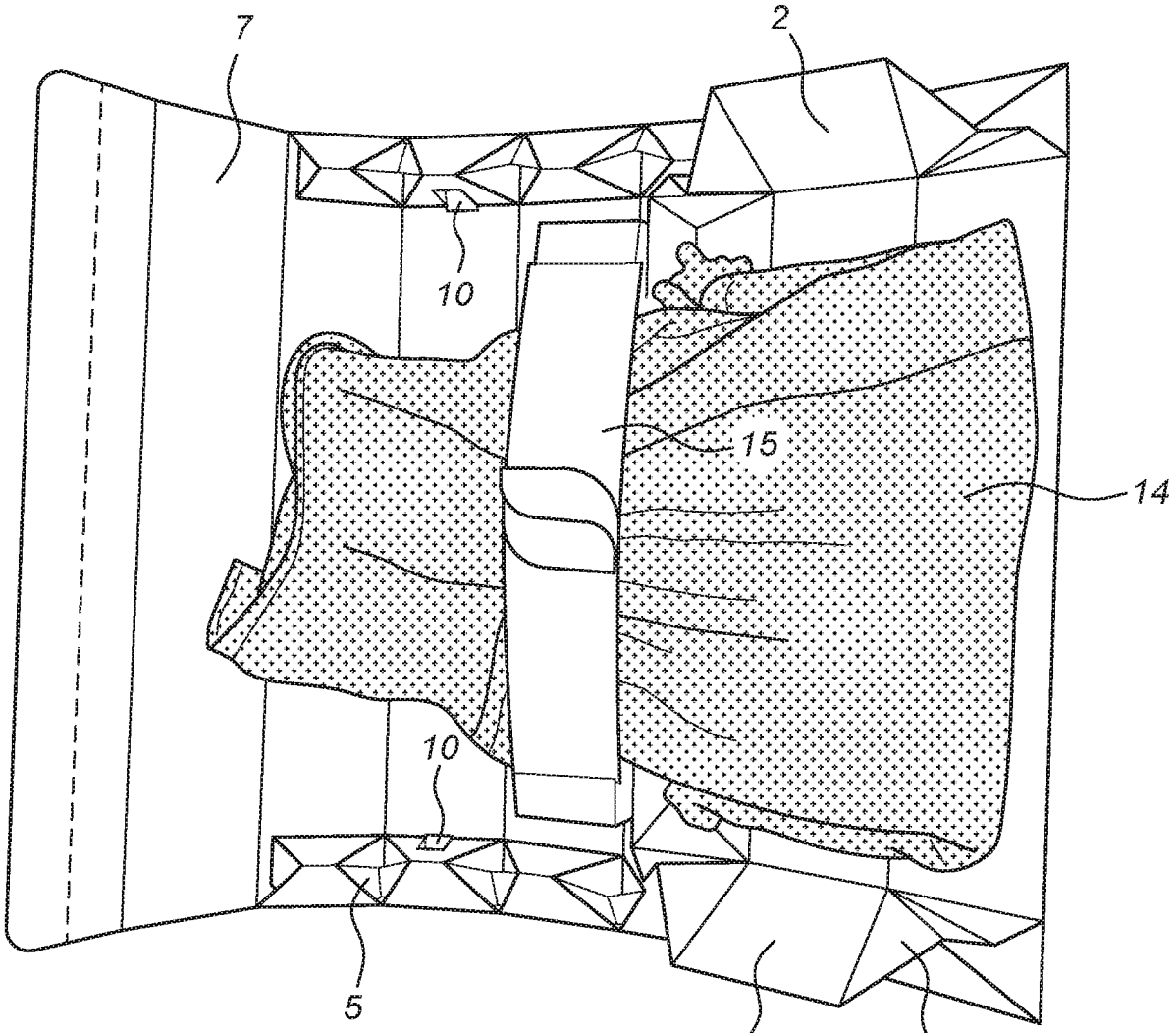
FIG. 2 shows an illustration of a second embodiment of the transport container.

FIG. 2 shows a second preferred variant of the transport container in which the core piece made from the plane of the casing comprises at least a first end face 2 and a second end face 12, wherein the first end face 2 and second end face 12 stand substantially perpendicular to the plane of the casing 7, and wherein the transport container is foldable about the core piece. After folding, the first end face 2 and the second end face 12 of the core piece lie on the two mutually facing faces of the upright edges. The core piece is furthermore provided with a reinforcement 13 which, on folding of the core piece, rests on the first end face 2 and the second 12 end face. In this embodiment variant, the core piece is provided with a fixing means, wherein the fixing means is provided with mutually engaging lips, wherein the fixing means enclose an object to be transported. This figure also shows a lock 15, which lock 15 is configured for holding an article of clothing 14.

Figure 3:
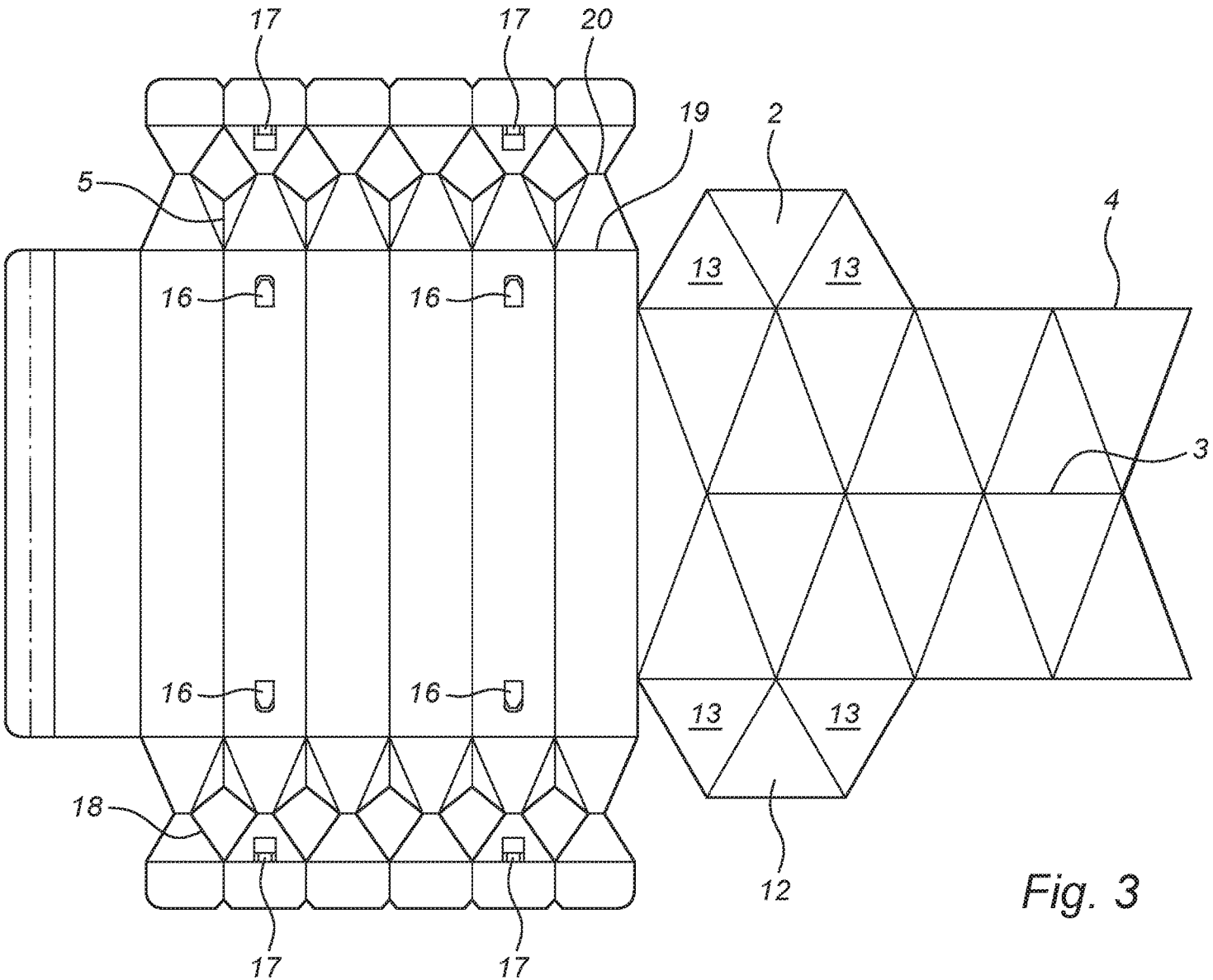
FIG. 3 shows a schematic illustration of the sheet from which the transport container is made.

FIG. 3 shows a sheet from which the transport container can be folded. The sheet is provided with a lock 16, 17 for the upright edge, wherein the lock is formed by at least one first lip 16 in the casing which engages foldably on at least one second lip 17 in the upright edge, wherein the at least one second lip is arranged in mutually facing faces of the upright edge. The upright edge is divided into edge segments, wherein a width 19 of each of the edge segments at least on the casing side is substantially equal to the width 19 of the corresponding casing segment. Also, wherein a width 20 of each of the edge segments on a side of the edge segment facing away from the casing is narrower than the corresponding casing segment 19. Because of the difference in width of parts of the edge segment, a region 18 is created which extends between two adjacent edge segments, wherein the region 18 contains a bendable element 5, wherein the two adjacent edge segments are connected together with the interposition of the bendable element 5. The core piece in this sheet comprises a first end face 2 and a second end face 12 which, after folding of the core piece, stand substantially perpendicularly to the casing. Furthermore, the core piece is provided with a reinforcement which, on folding, comes to rest on respective insides of the first end face 2 and second end face 12. In order to be able to transport a delicate object such as a bottle, the core piece is configured for engaging with a bottle in different positions 3, 4 in the width direction of the container, wherein the core piece is provided with engagement means 3, 4 in order, after folding, to limit or hinder a radial freedom of movement of the bottle. In this embodiment variant, the engagement means are at least provided with a first engagement part 3, wherein the first engagement part has a first inner diameter, and a second engagement part 4, wherein the second engagement part has a second inner diameter.

Figure 4:
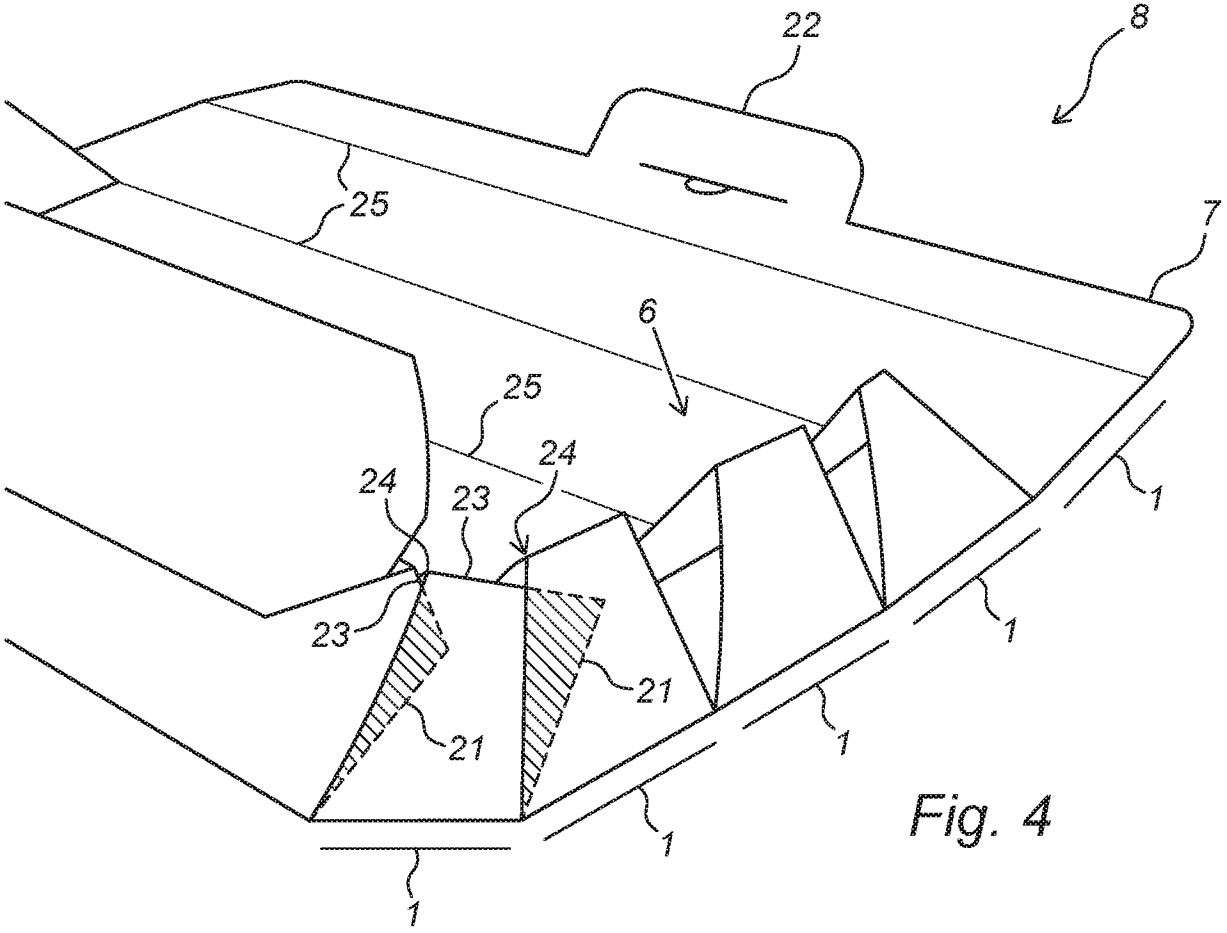
FIG. 4 shows a schematic illustration of an alternative embodiment variant of the transport container.

FIG. 4 shows yet a further embodiment variant of the transport container 8 according to the present invention. Here, the casing 7 is shown which is divided into several casing segments 1. The rigid upright edge 6 is arranged on several adjacent casing segments 1, wherein the upright edge 6 is divided into several edge segments 1 corresponding to the casing segments. In this embodiment variant, the edge segments have a triangular cross-section. The several casing segments 1 together with the corresponding edge segments 1 can be folded about common rotational axes 25 located in the plane of the casing 7. In this embodiment variant, the edge segments are formed such that, during rolling up of the casing, the edge segments 1 nest inside one another. Here, a part of the edge segment 1 is situated inside another edge segment. The rolling up of the transport container may for example be limited by forming the edge segments 1 such that a back part 23 of the nesting edge segment 21 runs against a back part 24 of the edge segment in which it nests. In this way, is it easy to ensure not only that the transport container 1 is well folded, but also that the side edge of the transport container 8 is completely closed from the outside in the rolled state. This is because in the fully rolled state, all edge segments are nested inside one another. In this position, for example a locking lip 22 may be used for sealing the rolled transport container 8.

The invention claimed is:

1. A transport container for transporting a delicate object, comprising: a casing which is divided in a length direction into several casing segments, wherein the casing is provided with at least two upright edges extending in the length direction, and situated spaced apart from one another in a width direction extending transversely to the length direction, wherein the upright edges are divided into edge segments corresponding to the several casing segments, wherein at least two adjacent casing segments each comprise at least two edge segments situated spaced apart from one another in the width direction, wherein the at least two adjacent casing segments together with the corresponding edge segments are foldable about a common rotational axis situated in the plane of the casing, wherein when in a folded state, the edge segments are rigid in at least one direction perpendicular to the plane of the corresponding casing segments and the edge segments are configured to partially nest inside one another.

2. The transport container as claimed in claim 1, wherein the region which extends in the width direction between the at least two upright edges is free from obstacles at least over a region that extends over several casing segments, and preferably over the entire length direction of the casing.

3. The transport container as claimed in claim 1, wherein the transport container is made of a material having a weight between 0 and 500 $g/m^2$ and/or a density between 0 and 0.04 $g/cm^3$.

4. The transport container as claimed in claim 1, wherein a width of each of the edge segments at least on the casing side is substantially equal to the width of the corresponding casing segment.

5. The transport container as claimed in claim 1, wherein a width of each of the edge segments on a side of the edge segment facing away from the casing is narrower than the corresponding casing segment.

6. The transport container as claimed in claim 5, wherein a region which extends between two adjacent edge segments contains a bendable element, wherein the two adjacent edge segments are connected together with the interposition of the bendable element.

7. The transport container as claimed in claim 6, wherein the bendable element is bendable with at least one direction component in a direction perpendicular to the casing.

8. The transport container as claimed in claim 6, wherein the bendable element is a bridge between adjacent edge segments, wherein the bridge is bendable in a direction perpendicular to the casing, and wherein in an unbent state, the bridge extends in a plane substantially parallel to a plane in which the casing extends.

9. The transport container as claimed in claim 6, wherein the upright edges have a substantially triangular cross-section.

10. The transport container as claimed in claim 9, wherein mutually facing faces of the upright edges stand substantially perpendicular to the casing.

11. The transport container as claimed in claim 9, wherein an end in the length direction of the casing is provided with a core piece, wherein the core piece comprises at least a first and a second end face, wherein the first and second end faces stand substantially perpendicularly to the plane of the casing, and wherein the transport container is foldable about the core piece.

12. The transport container as claimed in claim 10, wherein after folding, the first and second end faces of the core piece rest on the two mutually facing faces of the upright edges.

13. The transport container as claimed in claim 11, wherein the core piece is configured for engaging with a bottle in various positions in the width direction of the container, wherein the core piece is provided with engagement means for restricting or hindering a radial freedom of movement of the bottle.

14. The transport container as claimed in claim 13, wherein the engagement means are provided at least with: a first engagement part, wherein the first engagement part has a first inner diameter, a second engagement part, wherein the second engagement part has a second inner diameter.

15. The transport container as claimed in claim 12, wherein at least the first and/or the second end face of the core piece is also provided with reinforcement for supporting a base of the bottle, wherein the reinforcement rests on the first and/or second end face.

16. The transport container as claimed in claim 12, wherein the transport container is completely foldable from one sheet.

17. The transport container as claimed in claim 16, wherein the upright edge also contains a lock for locking the upright edge on the casing in a folded state, wherein the lock is formed by at least one first lip in the casing which engages foldably on at least one second lip in the upright edge, wherein the at least one second lip is arranged in mutually facing faces of the upright edge.

18. The transport container as claimed in claim 17, wherein the at least one first lip has a protrusion which engages in a corresponding recess in the at least one second lip.

19. The transport container as claimed in claim 17, wherein the lock is formed by at least one lip in the casing, wherein the lip engages in a recess in the upright edge.

20. The transport container as claimed in claim 17, wherein the casing also comprises a cover for at least partially and preferably completely covering a side face of the transport container after folding.

21. The transport container as claimed in claim 17, wherein from a side view, the transport container has a substantially polygonal form after folding.

22. The transport container as claimed in claim 17, wherein the length of the separate edge segments differs, wherein after folding, the different edge segments create a substantially helical cavity.

23. The transport container as claimed in claim 5, wherein, the adjacent edge segments of the two adjacent casing segments are at least partially nested inside one another.

24. The transport container as claimed in claim 17, wherein the casing is divided into at least four, preferably at least six casing segments.

25. The transport container as claimed in claim 24, wherein the two upright edges are each divided into at least four, preferably at least six edge segments corresponding to casing segments, wherein the at least four and preferably the at least six adjacent casing segments each comprise at least two edge segments spaced apart from one another in the width direction.

26. A transport container for transporting a delicate object, comprising: a casing which is divided in a length direction into several casing segments, wherein the casing is provided with at least two upright edges extending in the length direction, and situated spaced apart from one another in a width direction extending transversely to the length direction, wherein the upright edges are folded and divided into edge segments corresponding to the several casing segments, wherein at least two adjacent casing segments each comprise at least two edge segments situated spaced apart from one another in the width direction, wherein the at least two adjacent casing segments together with the corresponding edge segments are foldable about a common rotational axis situated in the plane of the casing, wherein thanks to a folded structure, the edge segments are rigid in at least one direction perpendicular to the plane of the corresponding casing segments.

27. A transport container according to claim 26, wherein the upright edges have a triangular or a circular or a rectangular cross-section.

* * * * *